US010550532B2

(12) United States Patent
Trifan

(10) Patent No.: US 10,550,532 B2
(45) Date of Patent: Feb. 4, 2020

(54) AUTOMATIC LIGHTING SYSTEM OF THE TRANSVERSAL MARKING FOR CROSSING OF THE PEDESTRIAN WALKWAYS

(71) Applicant: Adrian-Ionut Trifan, Tulcea cod (RO)

(72) Inventor: Adrian-Ionut Trifan, Tulcea cod (RO)

( * ) Notice: Subject to any disclaimer, the term of this patent is extended or adjusted under 35 U.S.C. 154(b) by 0 days.

(21) Appl. No.: 15/527,831

(22) PCT Filed: Nov. 17, 2015

(86) PCT No.: PCT/RO2015/000025
§ 371 (c)(1),
(2) Date: May 18, 2017

(87) PCT Pub. No.: WO2016/080855
PCT Pub. Date: May 26, 2016

(65) Prior Publication Data

US 2017/0306577 A1 Oct. 26, 2017

(30) Foreign Application Priority Data

Nov. 20, 2014 (RO) ..... 2014-00896

(51) Int. Cl.
*E01F 9/582* (2016.01)
*F21S 8/00* (2006.01)
(Continued)

(52) U.S. Cl.
CPC ..... *E01F 9/582* (2016.02); *F21S 8/032* (2013.01); *F21S 9/032* (2013.01); *F21V 3/00* (2013.01);
(Continued)

(58) Field of Classification Search
CPC . E01F 9/547; E01F 9/559; E01F 9/582; F21S 8/032; F21S 9/032; F21V 3/061;
(Continued)

(56) References Cited

U.S. PATENT DOCUMENTS 5,431,510 A * 7/1995 Reinert, Sr. ..... B64F 1/20 404/26
6,384,742 B1 * 5/2002 Harrison ..... B61L 29/24 340/917
(Continued)

FOREIGN PATENT DOCUMENTS

CN 101763723 A 6/2010
CN 202744975 U 2/2013
(Continued)

OTHER PUBLICATIONS

Lim et al., Aug. 16, 2012, Espacenet EPO Patent Translate, KR20120089945A.*
(Continued)

*Primary Examiner* — Alan B Cariaso
(74) *Attorney, Agent, or Firm* — Adler Pollock & Sheehan P.C.

(57) ABSTRACT

The invention refers to a lighting automatic system for pedestrian crossing and to a method of making the markings for the pedestrian crossings. The system comprises several lighting units sank in the asphalt made of a box (2)welded by a netting (11) fixed on the bottom of the hole made for the mounting of the lighting units, the box (2) having an external frame (5) and being closed with a detachable cap (4) equipped with a window in which a protection frame is fixed (6) of a piece made of safety glass (8), the cap representing the transversal marking of the pedestrian crossing, in the interior of the box (2) being a LED lighting unit (1) powered by a net or a photovoltaic plant (14) mounted on a pile (17) in the proximity of the pedestrian crossing, on the surface of the cap (4) being poured bitumen subsequently painted with reflecting painting, so that the glass (8) in the mounted state of the system, to be at the level of the roadway (10).

16 Claims, 10 Drawing Sheets

(51) Int. Cl.

| | |
|---|---|
| ***F21S 9/03*** | (2006.01) |
| ***F21V 23/04*** | (2006.01) |
| ***F21V 3/00*** | (2015.01) |
| ***F21V 31/00*** | (2006.01) |
| ***G08G 1/005*** | (2006.01) |
| ***G08G 1/095*** | (2006.01) |
| *F21V 3/06* | (2018.01) |
| *F21Y 115/10* | (2016.01) |

(52) U.S. Cl.
CPC ..... *F21V 23/0464* (2013.01); *F21V 23/0471* (2013.01); *F21V 23/0485* (2013.01); *F21V 31/005* (2013.01); *G08G 1/005* (2013.01); *G08G 1/095* (2013.01); *F21V 3/061* (2018.02); *F21Y 2115/10* (2016.08)

(58) Field of Classification Search
CPC ..... F21V 3/0615; F21V 23/0464; F21V 23/0485; F21V 3/00; F21V 23/0471; F21V 31/005; G08G 1/005; G08G 1/095
See application file for complete search history.

(56) References Cited

U.S. PATENT DOCUMENTS

| | | | | |
|---|---|---|---|---|
| 6,398,399 | B1 * | 6/2002 | Neophytou | G02B 6/001 362/153.1 |
| 8,235,542 | B2 * | 8/2012 | Yohananoff | E01C 17/00 362/153 |
| 2005/0255273 | A1 * | 11/2005 | Gorman | G09F 19/22 428/40.1 |
| 2005/0270175 | A1 * | 12/2005 | Peddie | G08G 1/096783 340/907 |

FOREIGN PATENT DOCUMENTS

| | | | | |
|---|---|---|---|---|
| CN | 203225023 | U | 10/2013 | |
| CN | 203383170 | U | 1/2014 | |
| EP | 2230654 | A2 * | 9/2010 | G08G 1/07 |
| ES | 1069343 | U | 3/2009 | |
| ES | 1069434 | U | 3/2009 | |
| FR | 2711685 | A1 | 5/1995 | |
| GB | 346335 | A | 3/1931 | |
| GB | 346372 | A * | 3/1931 | E01F 9/559 |
| JP | 2001109995 | A | 4/2001 | |
| KR | 100934621 | B1 * | 12/2009 | |
| KR | 20120089945 | A * | 8/2012 | |
| RO | 91625 | A2 | 5/1987 | |
| RO | 125804 | B1 | 10/2010 | |
| RU | 2012118722 | A | 11/2013 | |
| WO | 2011129517 | A2 | 10/2011 | |

OTHER PUBLICATIONS

Park, Dec. 31, 2009, Espacenet EPO Patent Translate, KR100934621B1.*

Tamaoki Satoshi, "System of Recognizing and Displaying Laid Object and System of Recognizing and Displaying Crosswalk", Apr. 20, 2001, Espacenet JP2001109995 (A), Patent Translate Powered by EPO and Google, p. 1 Bibliographic Data, pp. 1-3 Claims, pp. 1-14 Description, pp. 1-3 Drawing Figures 1-16.*

Pastana Torres Santiago, "Circuito de Senalizacion Horizontal para Pasos de Cebra Peatonales, Semaforos y Similares", Mar. 16, 2009, ES1069434 (U), Patent Translate Powered by EPO and Google, pp. 1-2 Bibliographic Data & Abstract, pp. 1-2 Claims, pp. 1-5 Description, p. 1 Drawings Figures 1-2.*

Tamaoki Satoshi, "System of Recognizing and Displaying Laid Object and System of Recognizing and Displaying Cosswalk", Apr. 20, 2001, JP2001109995-A, Espacenet, pp. 1-14, abstract and drawings Figures 1-16.*

Pestana Torres Santiago Manuel, "Horizontal Signal Circuit for Pedestrian Zebra Steps, Semphories and Similar", Mar. 16, 2009, ES1069434-U,Patent Translate Powered by EPO and Google, pp. 1-5, bibliographic data/abstract and drawings Figures 1-2.*

ASRO Standard Roman, SR 1848-7, Dec. 2004, Asociatia De Standardizare Din Romania.

Extended European Search Report received in European Patent application No. 15861312.5, dated Nov. 20, 2018, 16 pages.

Partial Supplementary European Search Report received in European Patent application No. 15861312.5, dated Aug. 2, 2018, 16 pages.

International Search Report and Written Opinion received in PCT application No. PCT/R02015/000025, dated May 26, 2016, 6 pages.

* cited by examiner

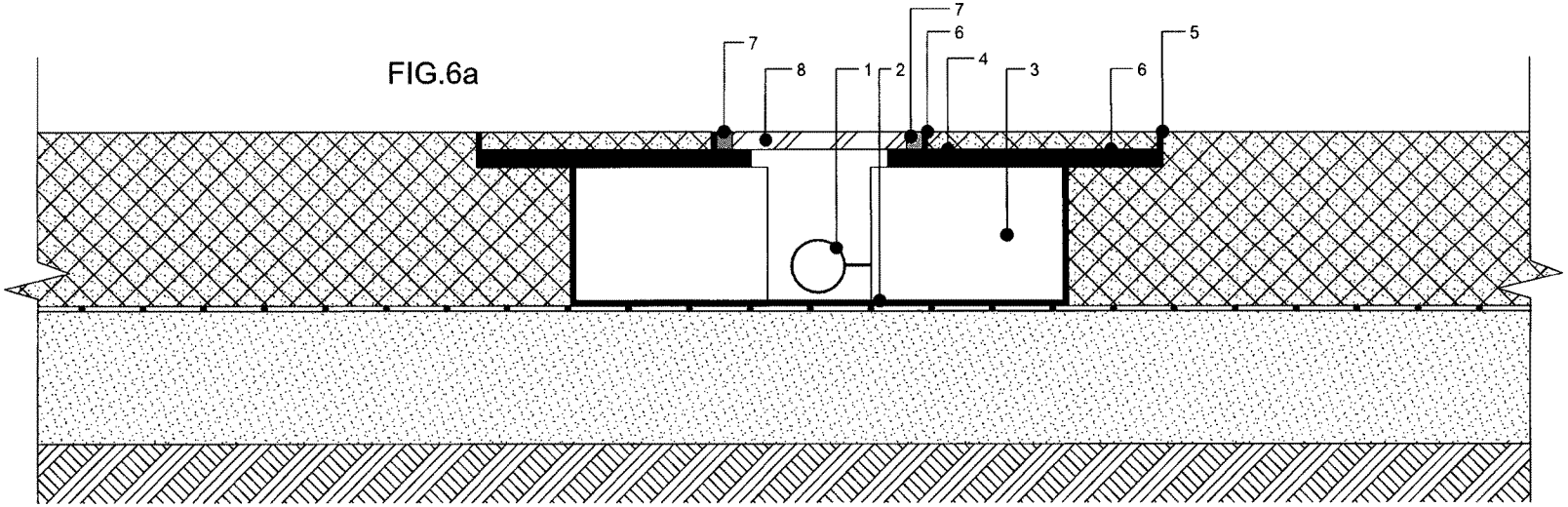
FIG.6a
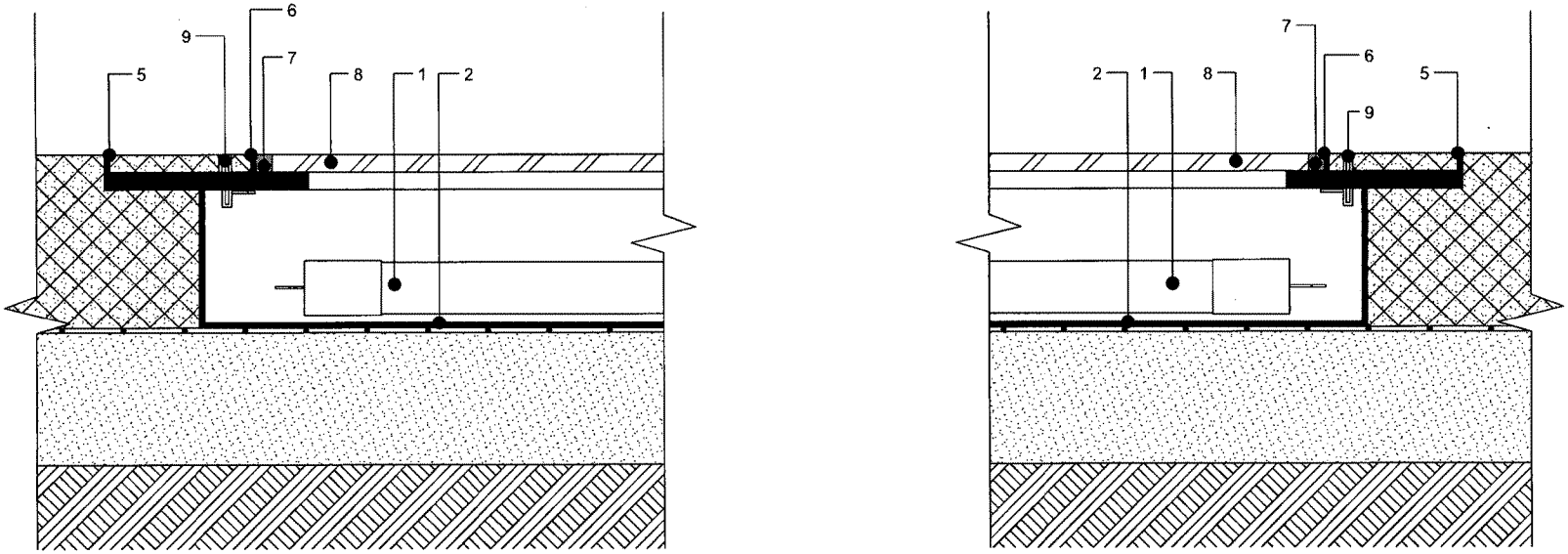
FIG.6b
FIG.6c
FIG.6

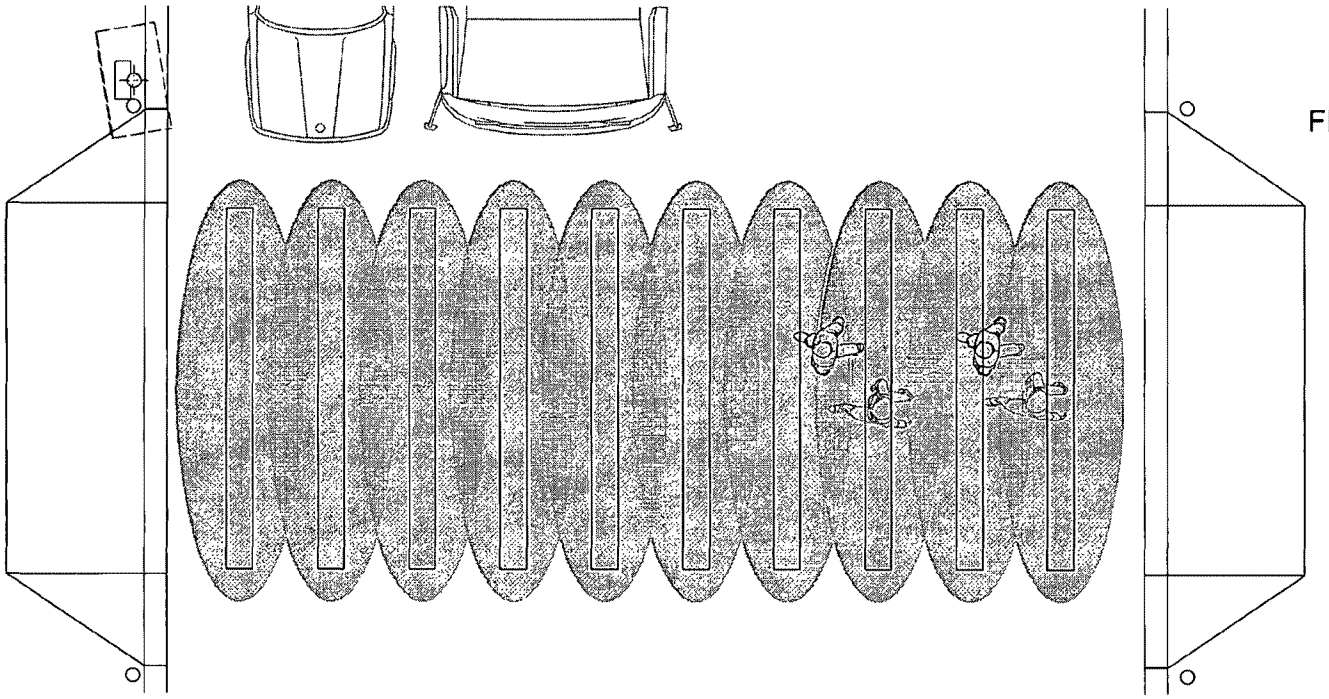
FIG.10a
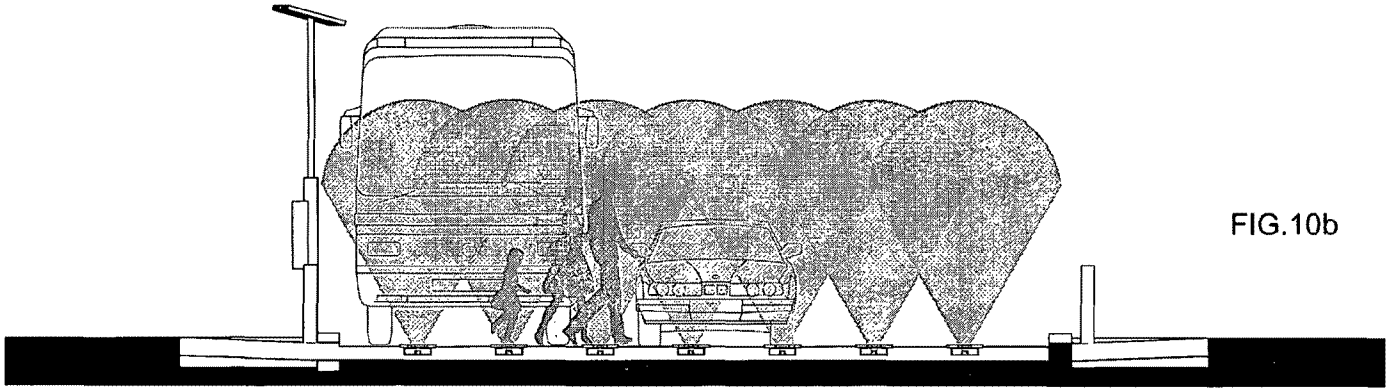
FIG.10b
FIG.10

AUTOMATIC LIGHTING SYSTEM OF THE TRANSVERSAL MARKING FOR CROSSING OF THE PEDESTRIAN WALKWAYS

CROSS REFERENCE TO RELATED APPLICATIONS

This application is a national phase filing under 35 U.S.C. § 371 of International Application No. PCT/RO2015/000025 filed Nov. 17, 2015, which claims priority from Romanian application number 201400896, filed Nov. 20, 2014, the entire contents of each are hereby incorporated by reference herein.

BACKGROUND OF THE INVENTION

Field of the Invention

This invention refers to traffic safety facilities, light transversal marks for the pedestrian crossings. More precisely, the current invention refers to an automatic light system of the transversal markings for crossing for the pedestrian walkways and to a process of making the transversal markings for crossing for the pedestrian walkways.

The low visibility during night, the snow during winter, the insufficient signalizing of the pedestrian crossings, as well as the fact that some drivers are blinded during the night by the lights of other traffic participants, turn a lot of traffic accidents to have as casualties the pedestrians who were crossing.

A solution to this issue is the intelligent systems of light adopted for the pedestrian crossings.

Description of related art including information disclosed under 37CFR 1.97 and 1.98

The paper RO91625 and RO 125804 B1 reveal examples of automatic signalizing devices for the pedestrians' presence in the close vicinity or on the pedestrian crossing, by using various lighting devices, activated by sensors.

In addition, there are also known right from the technical stage various technical solutions for signalizing during night/fog of the crossings/traffic lanes, by using buried or mounted over the road lighting devices (see, for instance, WO2011129517 A2, U.S. Pat. No. 6,384,742 B1, RU2012118722 A).

It is also known that marking the pedestrians' crossings represents an activity regulated at European level (in Romania by the Standard SR 1848-7:2004). This standard mention at General Provisions (see point 1.2) that the markings "must not disturb in any way the traffic and must not present slippery surface". Moreover, the same standard enforces that, for the pedestrian crossings, the transversal (white) strips must be 40 cm wide, and the space between two strips must be of 60 cm.

For instance, another solution is described in the Paper JP 2001109995 A referring to a lighting system of a pedestrian crossing by using light devices buried at road level. Each light device is formed of a box with LED-s inside, the upper part of the box being of transparent plastic material in order to allow for the lighting of the pedestrians who are crossing. The Led-s turning on and the lighting of the pedestrian crossing occur depending on various types of sensors of presence/pressure installed on the sidewalk. Despite providing for an efficient control of the lighting of the pedestrian crossing, the solution revealed in the Paper JP 2001109995A has some major disadvantages as it breaches right the general provisions of the Standard SR -1848-7-2004 mentioned above.

More precisely, the manufacturing of the upper side of the box from a board of plastic material 40 cm wide and 3-4 m long (as stipulated by the same Standard) is, not only on rainy weather, a very slippery surface both for the pedestrians, and for the vehicles, the lid length being larger that the width of a vehicle wheel, therefore the adherence being much more lower. In addition, the resistance insured by the board of plastic material for the heavy traffic (for instance, a maximal mass of each axis of 9 tons) or its capacity to remain transparent in terms of intense contact with abrasive materials are also noticeable disadvantages. Moreover, the Paper JP 2001109995 A does not reveal and does not suggest how the access to the inside of the box is provided in case of maintenance operations, nor it does mention the factual proceeding to bury the boxes of the lighting devices.

The main object of the current invention is to provide for an improved solution related to the provisions of the Paper JP 2001109995 A, especially with regard to an increased robustness of the lighting bodies, even for the heavy traffic, to an increased safety both for the pedestrians and for the vehicles crossing over the marking achieved according to the current invention, and not lately for lesser time for installing it.

Another objective of the current invention is to provide an automatic lighting system of the transversal markings for the pedestrians' crossings and the process to manufacture the transversal crossing markings for more economic crossings.

A supplementary objective of the current invention is to provide for an automatic lighting system of the transversal marks for crossing for the pedestrians' crossings and a process to produce the transversal crossing marks for the pedestrians' walkways which to respect the provisions of the Standard SR 1848-7:2004.

BRIEF SUMMARY OF THE INVENTION

These objectives are achieved with an automatic lighting system of the transversal markings of the pedestrians' crossings which has the technical characteristic for the independent claim 1 and with a process for manufacturing the transversal crossing marks for pedestrians' walkways according to the independent claim 7.

The preferred examples for achieving the invention are formulated in the enclosed dependent claims.

The system in accordance with the current invention will prove its efficiency at the pedestrians' crossings which are weakly illuminated or even without light, at the pedestrians' crossings at the curve, during winter, when the markings are covered by snow, and on the roads with several traffic lanes on one way, where, in case there are vehicles in traffic on all lanes of a way their visibility at a pedestrian crossing is a lot diminished because of the other cars, the light of the transversal marks pointing them out that there is a pedestrian in crossing without even being needed to see the respective pedestrian.

According to the invention, the automatic lighting system of the transversal markings for the pedestrian crossing is formed of lighting metallic bodies, endowed with an ensemble of illumination by LED technology, which are introduce under the location of the previous pedestrian crossing by stripping the road. The lighting bodies are welded to a reinforcing steel net, placed on the bottom of the ditch stripped in the asphalt. The metallic lighting bodies have on the lid a central cut, and above it tempered sandblasted glass (to prevent the reflection of the light during the sunny days), glass through which the illumination of the transversal marking is performed, and, implicitly, the lighting of the pedestrian's silhouette. A layer of asphalt bitumen is poured on the lid of the metallic lighting device, which is painted in reflectorizing paint as according to the European Standard in the area. Consequently, the lid of the metallic device turns into transversal marking of the pedestrian crossing. These metallic lighting devices, welded on the reinforcement net and connected to the electric network and to a sensors network are buried in the road. During night, the twilight sensor will switch on the electric circuit of the system allowing that, when a pedestrian steps on the weight sensors on the sideway and/or interrupts the laser rays of the laser barrier, the system becomes active by lighting the transversal markings of the pedestrian crossing. Consequently, the crossing transversal markings will light on, warning the drivers on the existence of a pedestrian crossing, on pedestrians' existence who are crossing the street by lighting their silhouettes or on a person's intention to cross, therefore allowing them to take the necessary measures in time (breaking, reducing the speed, stopping, etc.). In a certain time delay, after crossing the street, the automatic lighting system stops, warning the drivers that there is no person intending to cross the street or in process of crossing the walkway. The activation of the weight sensors and of the laser barriers will provide enough time for light signal, for safety crossing of the pedestrian walkway.

According to the invention, the automatic lighting system of the transversal crossing markings for the pedestrian walkways and the process to manufacture the transversal crossing marking for the pedestrian walkways have the following advantages:

- Easy and quick installation of the system without blocking the traffic for too long;
- It is an economic system with low costs of installation, maintenance and exploitation;
- It provides better visibility of the pedestrian crossing by lighting up the transversal markings;
- It provides better visibility of the pedestrians in crossing process by lighting on their silhouettes;
- It warns the drivers on the presence of a person in crossing the walkway by automatic lighting of the transversal markings, lighting which starts when the sensors sense the person's presence and the person's intention to cross the street, in the vicinity of the crossing.

BRIEF DESCRIPTION OF THE SEVERAL VIEWS OF THE DRAWING

Further, there is an example which is just illustrative and not limitative on how to produce the automatic lighting system of the transversal crossing markings for the pedestrian walkways and on the process of doing them according to the invention, in relation with the attached images, indicating.

DETAILED DESCRIPTION OF THE INVENTION

Figure 5:
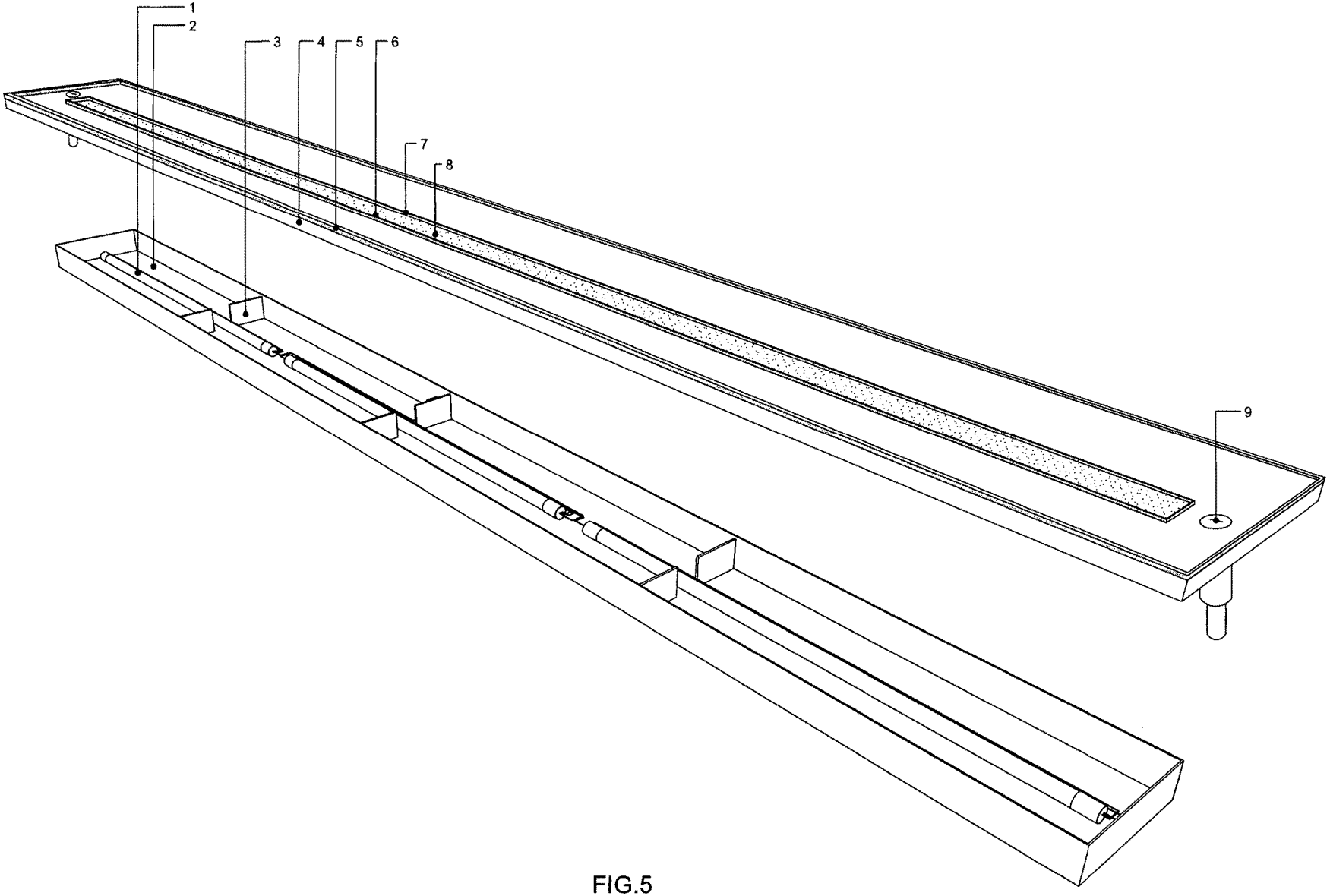
Figure 7:
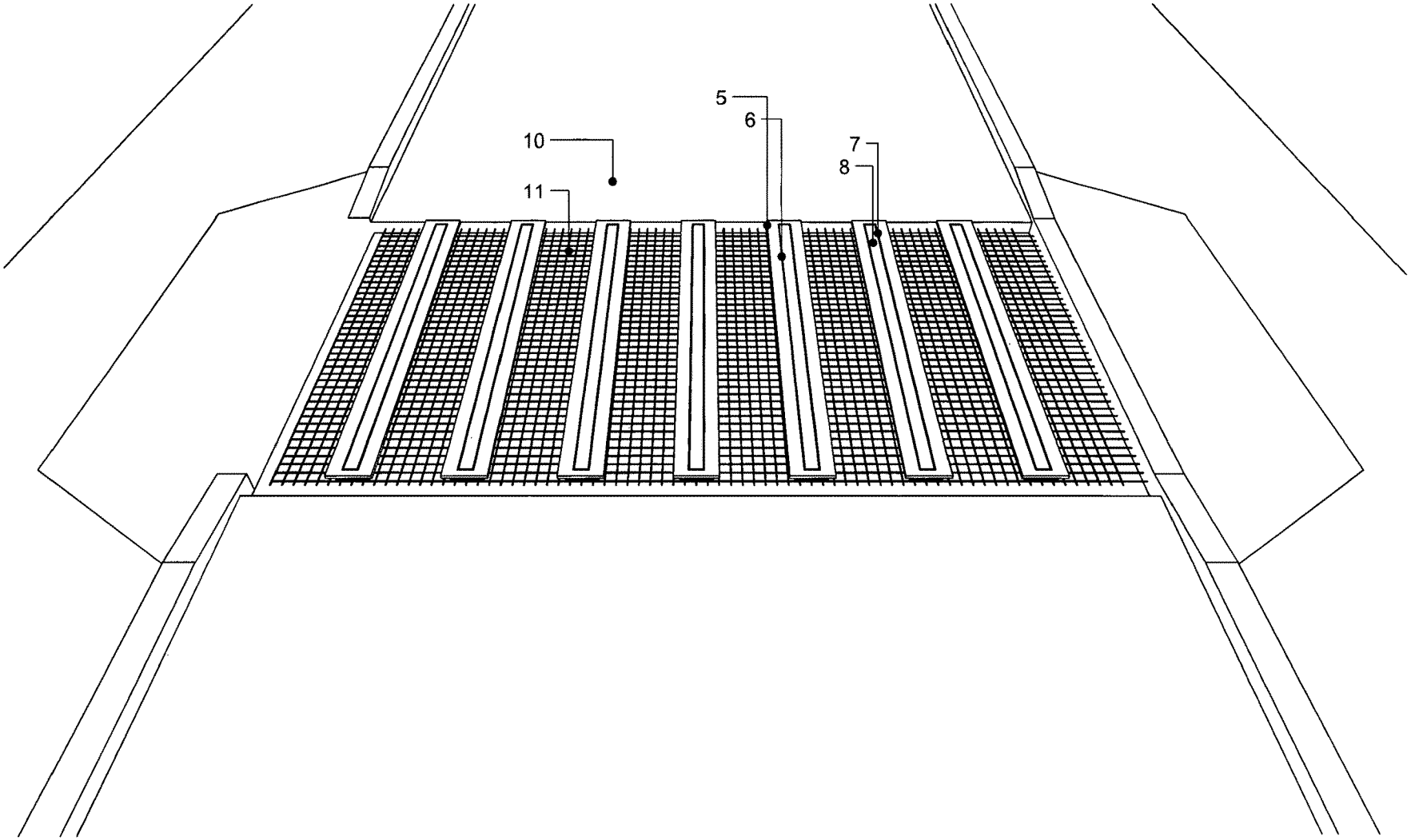
Figure 9:
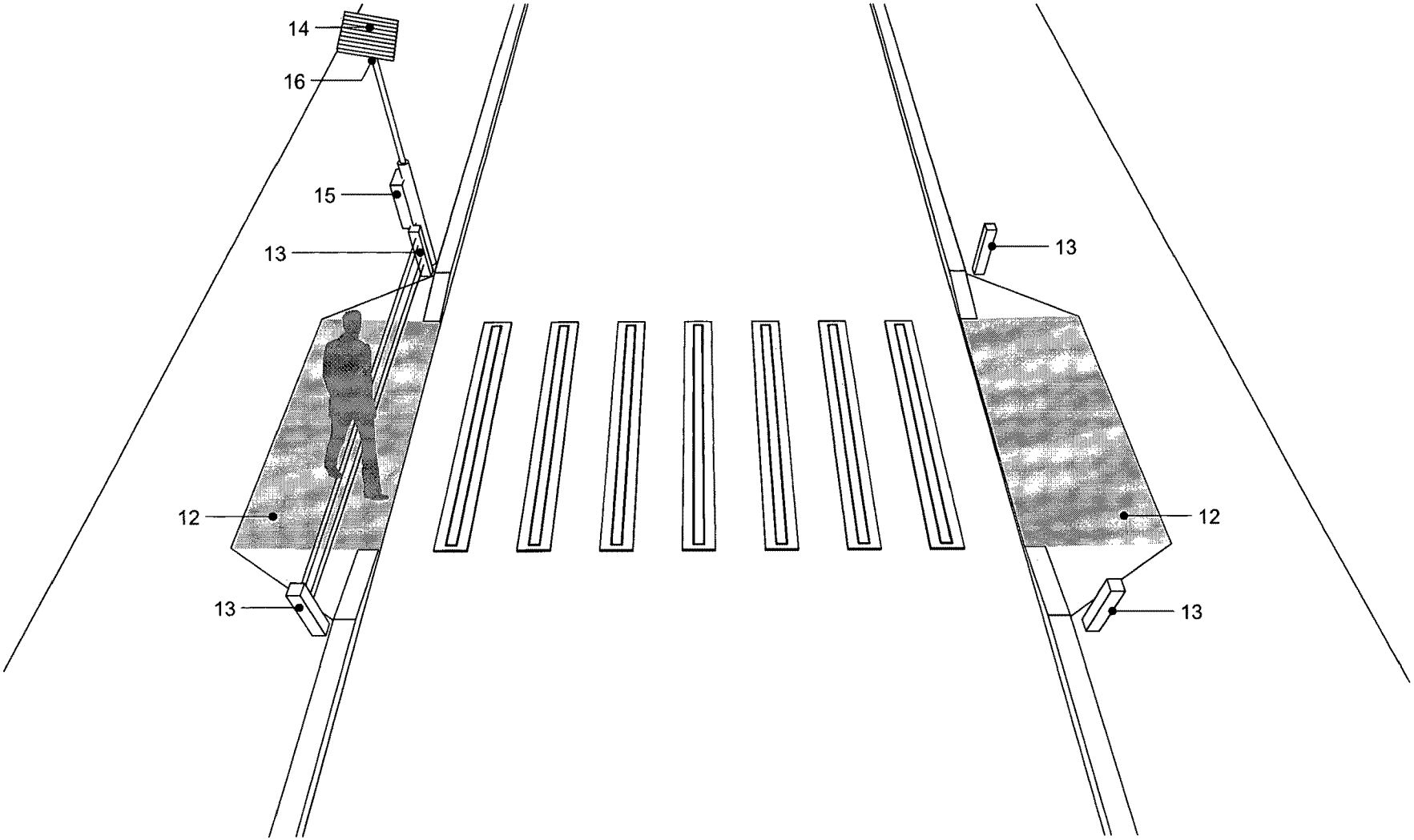

According to the invention, the system of automatic lighting of the transversal crossing markings for the pedestrians' crossings, presented in FIG. 9, comprises:

In FIG. 5, the metallic lighting device can be noticed, formed of a rectangular metallic box 2 of steel sheet, having on the bottom welded reinforcing elements 3 for supporting the vehicles loads, a rectangular lid 4 of thick steel sheet to resist the high loads of the vehicles. This lid of the metallic light device has an opening cut in the center of it on which the sandblasted tempered glass is to be stuck 8 and a cord of silicone putty 7 is to be used in order to insulate the metallic light body against the water infiltrates. In FIG. 6*a*—the upper section—we can see the lid 4 of the lighting device which has welded two steel sheet frames, one frame 5 on the edge of the lid, and the other frame 6 centrally around the lid cut, with role of protection of the tempered glass 8. Both steel sheet frames have the same height as the sandblasted tempered glass. A layer of asphalt bitumen is to be applied between the two welded frames 5 and 6, thick as the height of the two frames which will be painted with reflectorizing paint afterward as provided by the European Standard in the area. Consequently, the lid of the box turns into the transversal marking of the pedestrian crossing like in FIG. 7. The lid 4 of the light device has the standard length and width of the transversal crossing marking for the pedestrian crossing as stipulated by the European legislation in the area. The lid 4 of the metallic light device has two systems of closing 9 with the help of which the access inside the metallic light device of the unauthorized persons and it could be used for lifting the lid in case of malfunctions occurred at the LED lighting unit 1, see FIG. 5.

The LED lighting unit 1 will light through the cut of the lid and through the sandblasted tempered glass 8, the transversal crossing mark of the pedestrian walkway which is represented by the lid of the metallic box of the light device represents, see FIG. 5. The LED lighting unit 1 is to be caught with special hooks on the bottom of the metallic light box 2 and will have tubes with LED technology or LED band.

The sandblasted tempered glass 8 has the role of optic element, protecting the LED lighting unit 1 and the inside of the light metallic device from the external factors. A cord of silicone putty 7 is to be poured between the metallic frames 6 for protection of the glass and the sandblasted tempered glass 8 in order to insulate the metallic light device against the water infiltrations, see FIG. 6. The tempered glass is to be sanded on the surface for preventing the light reflection during sunny days.

Figure 2:
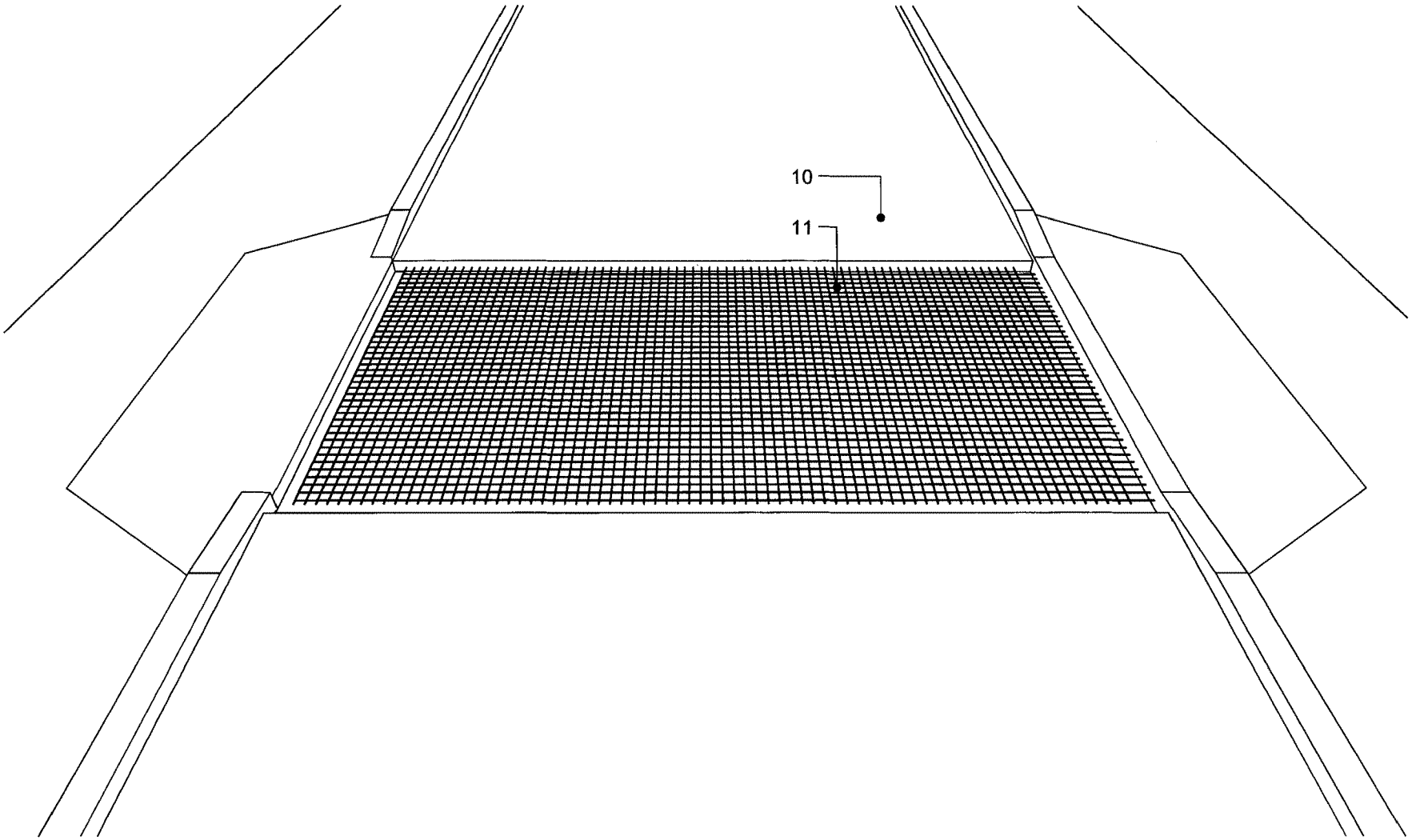
FIG. 2—View of the metallic net mounted and fixes at the bottom of the stripped ditch FIG. 3—View of the metallic lighting boxes, welded on the reinforced steel net FIG. 4—View of the metallic lighting boxes equipped with the LED lighting unit FIG. 5—View of the metallic lighting device equipped, without asphalt bitumen on the lid FIG. 6*a*-6*c*—Views in transversal and longitudinal sections of the metallic body buried in the asphalt bitumen FIG. 7—View of the metallic lighting devices, totally equipped and welded on the metallic net FIG. 8—View of the automatic lighting system of the transversal marking for pedestrian walkways, equipped with metallic lighting devices, sensors, and system of photovoltaic panels not buried into the asphalt bitumen FIG. 9—View automatic lighting system of the transversal markings for the pedestrians' walkways fully installed and covered by asphalt bitumen FIGS. 10*a*, 10*b* —Example of lighting of the pedestrian crossing and of the pedestrians' silhouette-side and above views

The metallic net 11 is a reinforced steel net, used to reinforce and fix the ensemble formed of metallic light devices in order to increase the reinforcing surface and to stabilize the tension forces occurred after the asphalt layer, as seen in the FIG. 2. This metallic net 11 is necessary because the buried height of the light metallic devices is very low, and so it is their weight, the net reinforcement stabilizing the weight forces which act on the entire system.

The pressure sensors 12 have the role to automatically start the LED lighting unit 1 of the light metallic device. The moment when a pedestrian applies a pressure (steps) on these sensors 12 like in the FIG. 9, the LED lighting units 1 of the metallic light devices will automatically start the lighting of the transversal markings, warning the drivers on the intent of crossing from a pedestrian or the presence on the pedestrian crossing of a person engaged in crossing the street and will light one's silhouette during the action. This system is to be used also a back-up system in case of malfunction of the laser barrier and vice versa.

Laser sensors (laser barriers) 13 have the role of automatically starting the LED lighting unit 1 of the light metallic box. The interruption of the laser beams of the barrier caused by a pedestrian crossing among the pillars of the laser barrier as in FIG. 9 will automatically start the LED lighting units 1 of the light metallic devices which will light the transversal markings, warning the drivers on a pedestrian's intention to cross the street or on a pedestrian's presence on the crossing and will light the person's silhouette during the crossing.

The twilight sensor (the light sensor) 16 represented in the FIG. 9 will switch on the electric circuits of the LED lighting units 1 of the metallic light devices at night. This sensor could be set to start the automatic lighting system of the transversal marking for the pedestrian walkways at various intensities of the natural light.

The photovoltaic power plant 14 represented in FIG. 9 is to be used at interruption in the power supply of the local energy network, but also when the technical solutions do not allow the connection of the system to the local energy network (isolated areas).

The electric control panel 15 represented in FIG. 9 comprises the electrical and command parts of the automatic light system of the transversal marking and the accumulators of the photovoltaic plant.

According to the invention, the automatic light system of the transversal crossing markings for pedestrian walkways is formed of metallic light devices, equipped with lighting unit 1 with LED technology, introduced below the location of the old pedestrian crossing by stripping of the road like on FIG. 9.

Figure 3:
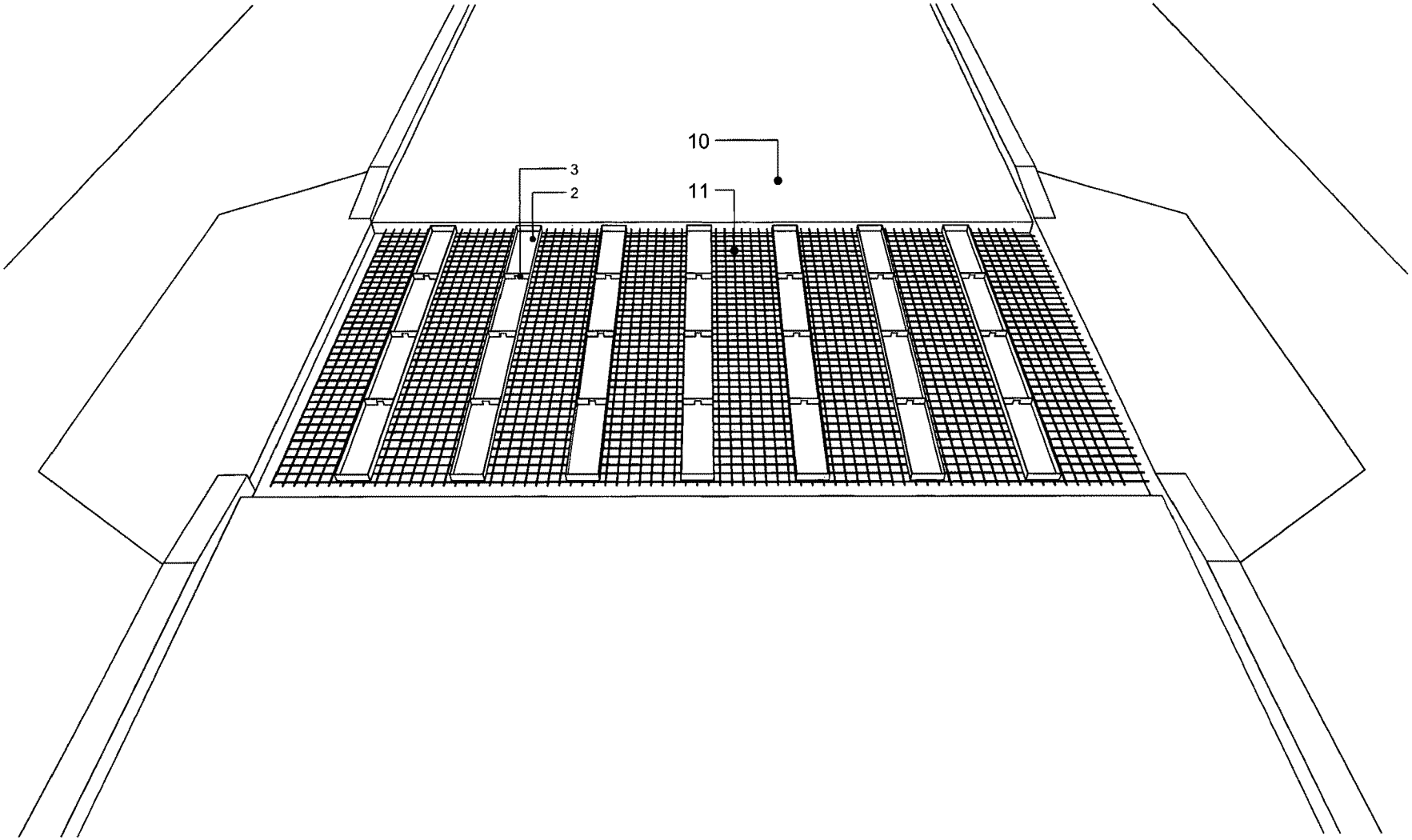
Figure 4:
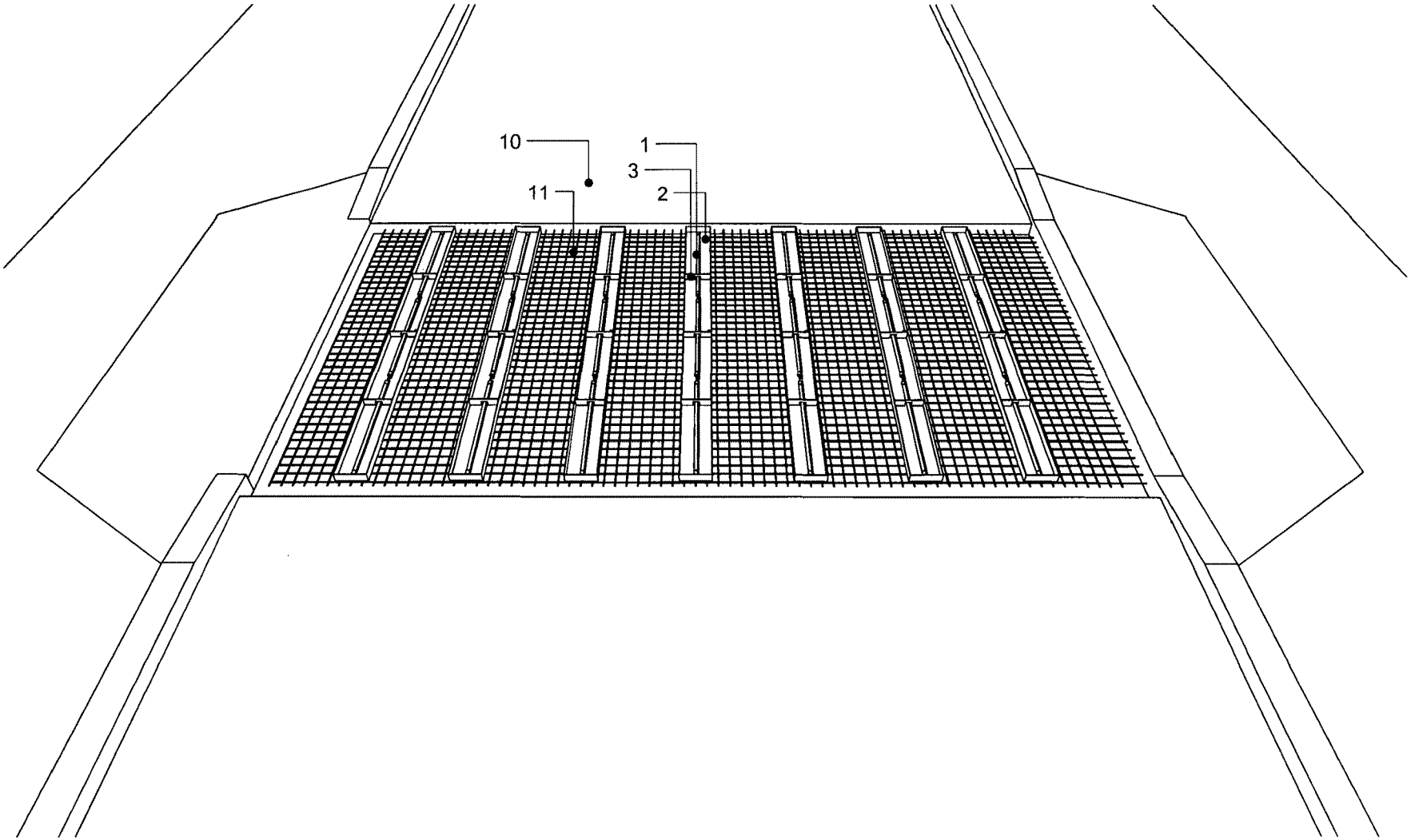

The boxes of the metallic light devices are welded on a metallic net 11, places on the bottom of the stripped ditch in the asphalt like in FIG. 3. The optical element of the metallic light devices is formed of the central cut in the lid and the sandblasted tempered glass 8, stuck on this central cut of the lid. By this optical element, highlighted in the FIG. 5, the lighting of the transversal marking is performed and, consequently, the lighting on the pedestrians' silhouettes occurs. A layer of asphalt bitumen is poured on the lid 4 of the metallic light device which, later on, is painted with reflectorizing paint as stipulated in the European Standard in the area. The boxes of the metallic light devices welded by the metallic net 11, equipped with the LED lighting unit 1 are to be connected to the electric network and to a network of a pressure sensor 12, a laser sensor 13, and a twilight sensor 16 like in the FIG. 8.

After these operations, the lids 4 of the metallic light bodies are closed and equipped with sandblasted tempered glass 8 like in FIG. 6.

We can see in FIG. 9 how all this constructed ensemble is to be buried in asphalt bitumen until the height of the external frames 5 of the lids of the light devices, which are at the same level with the road 10.

So, the lid 4 of the metallic lighting device equipped with sandblasted tempered glass 8 becomes the transversal illuminated marking of the pedestrian road crossing.

In the FIG. 9 it can be observed that by nightfall, the twilight sensor 16 will switch on the electrical circuit of the system allowing when a pedestrian steps on the pressure sensors 12 located on the sidewalk and/or interrupts the laser sensors (laser barrier) 13 the system becomes active by illuminating the transversal marking of the pedestrian crosswalk.

In the FIG. 9 it is shown how the crossing transversal marking will light up and illuminate the silhouettes of the persons engaged in crossing the street on the pedestrian crosswalk, warning the drivers about the existence of the crosswalk, about the pedestrian engaged in road crossing or about the pedestrian intention to cross the road, allowing the driver to take the appropriate actions (breaking, speed reducing, stopping, etc.). After pedestrian cross, at a certain period, the automatic lighting system of the transversal marking will stop, informing the drivers that no person has the intention to cross or is engaged in crossing the crosswalk. The period of time for each activation of the pressure sensors 12 and of the laser sensors (laser barrier) 13 will be set up by a timer, allowing a sufficient lighting time of the transversal marking, for safe crossing of the crosswalk even for persons with disabilities.

The system can be powered up by night time using the batteries of the photovoltaic system 14.

Setup Metode

Figure 1:
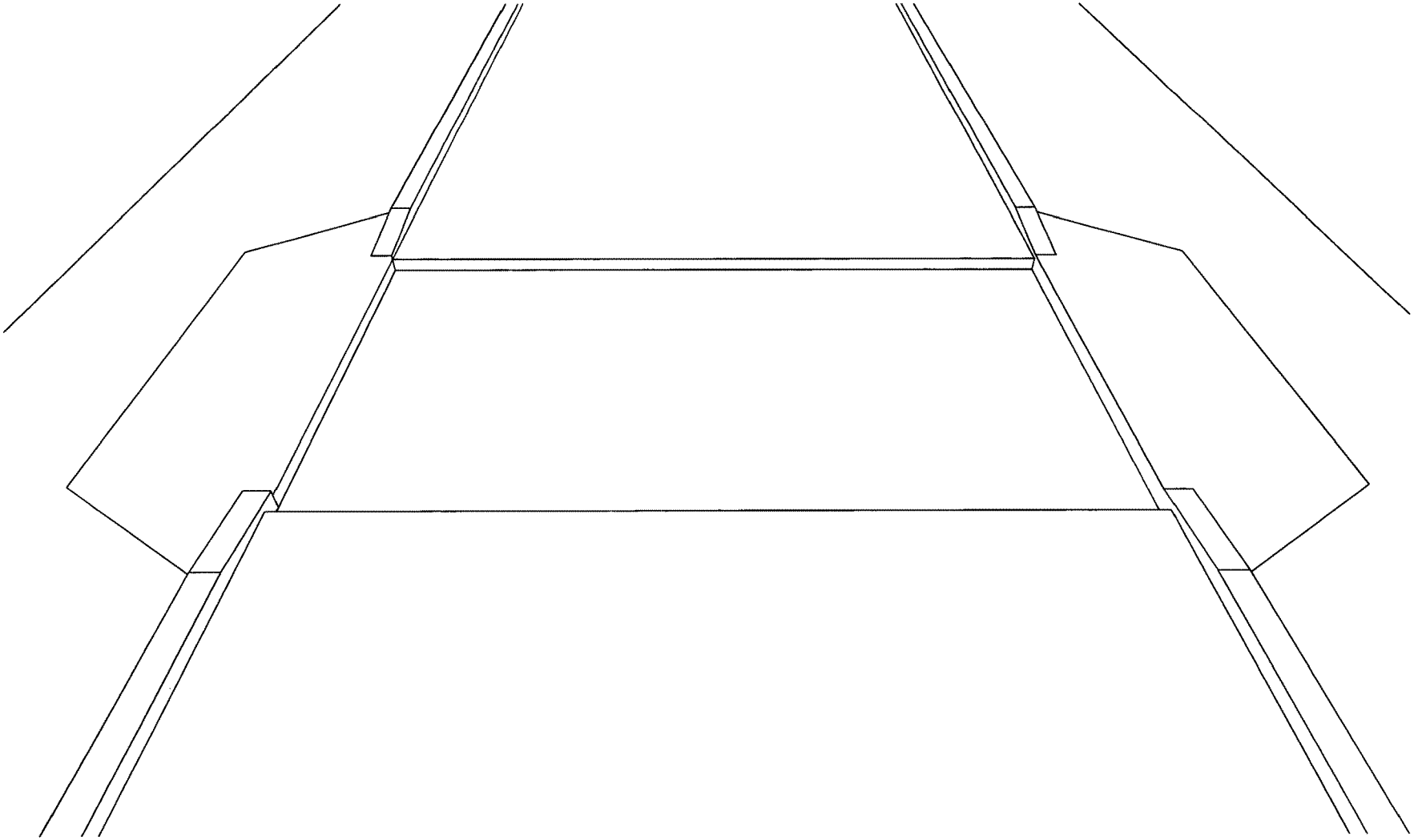
FIG. 1—Stripped road view

The asphalt will be stripped out on all length and width of the old crosswalk, as shown on FIG. 1

In FIG. 2 it can be seen on the bottom of the pit formed in this way how the metallic nets 11 are stretched and fixed, on which it will be welded the boxes 2 of the metallic lighting devices.

In FIG. 3 it can be seen how the boxes 2 of the metallic lighting devices, which have the standard length of the transversal markings for the pedestrian crossings provided by the European laws in the field, will be welded on the metallic net 11 at the STAS distance provided by the same legislation. The welding from the metallic net is necessary for stabilizing the forces of tension and weight of the system.

After this operation the boxes 2 of the metallic lighting device equipped with the LED lighting unit 1 will be connected in parallel trough the electrical wiring to the electric control panel 15 and to the pressure sensor 12, laser sensor 13 and twilight sensor 16. The electrical wiring will be protected by the Copex metal tubes.

Figure 8:
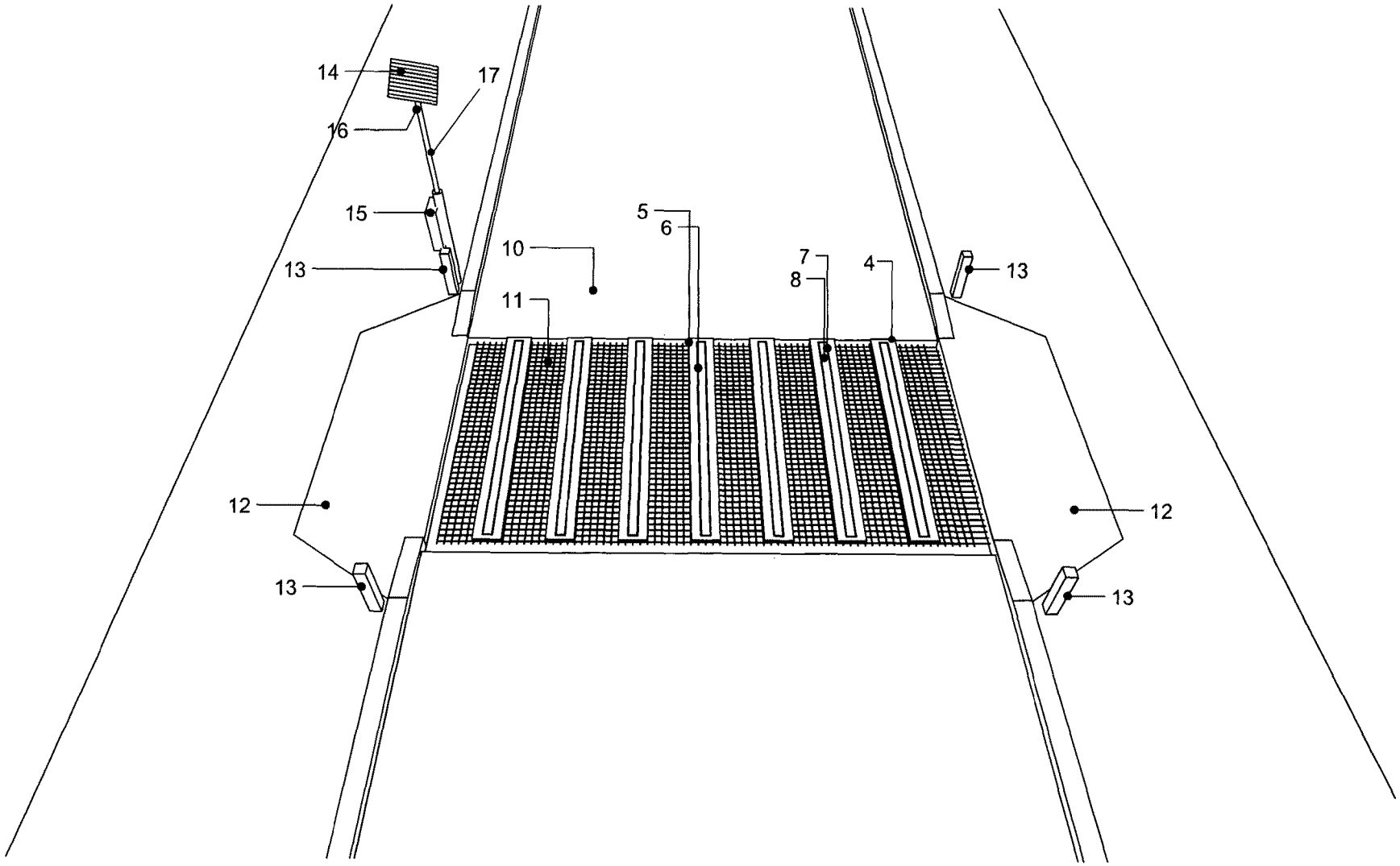

After the above operations, we will start the installation of the pressure sensor 12, laser sensor 13 and twilight sensor 16, of the photovoltaic power plant 14 and of the electric control panel 15 as seen in FIG. 8, as follow:

In FIG. 8 it can be seen that the pressure sensors 12 will be installed under ceramic or concrete plates disposed in the area of the crosswalk, on both sidewalks.

In FIG. 8 it can be seen that the laser sensors (laser barriers) 13 will be installed on both sidewalks, all through the width of the crosswalk, near the crimps.

In FIG. 8 it can be seen that the twilight sensor (sunlight sensor) 16 will be installed on the metallic pole 17 which will hold the photovoltaic plant 14.

In FIG. 8 it can be seen that the photovoltaic plant 14 will be mounted on the metallic pole 17 located on one of the sidewalks near the crosswalk.

In FIG. 8 it can be seen that the electric control panel 15 will be mounted on the metallic pole 17 of the photovoltaic plant.

After all these operations the lids 4 of the metallic lighting devices will be mounted and closed equipped with the sandblasted tempered glass 8. It will be poured asphaltic bitumen on top of the metallic lighting device lid 4 between the exterior frame 5 and the protection frame 6 of the sandblasted tempered glass for a good grip of the tires of cars—see FIG. 6*a*—above section. As we can see in FIG. 5 although not presented in the scale, the strip of the sandblasted tempered glass 8, represents less than ⅓ of the total length of the lid 4, with a length of 10-13 cm. this dimension represents less than the width of a tire for an adequate grip. The asphaltic bitumen poured on the lid between the exterior frame 5 of the 4 of the metallic lighting device, the interior protection frame 6 of the glass will be painted entirely in accordance with the European Standards and will be the transversal marking of the crosswalk. As you can see in FIG. 9, the entire explained in FIG. 8, will be buried in bitumen till the level of the external frames 5 of the metallic lighting device, at the same level with the road 10, becoming functional for both cars and pedestrians.

LIST OF REFERENCES

| NR. CRT | NAME |
|---|---|
| 1. | LED Lighting kit unit |
| 2. | Box of the metallic lighting device |
| a | Reinforcing elements |
| 4. | Lid of the lighting metallic t device |
| 5. | Frame of the lid lighting metallic device |
| 6. | Protection frame for tempered glass |
| 7. | Silicone putty |
| 8. | Sandblasted tempered glass |
| 9. | Closing system of the lighting metallic device |
| 10. | Road |
| 11. | Metallic net |
| 12. | Pressure sensors |
| 13. | Laser Sensors (Laser barrier) |
| 14. | Photovoltaic power plant |
| 15. | Electric control panel |
| 16. | Twilight sensor |
| 17. | Metallic pole |

What is claimed is:

1. An automatic lighting system of transversal markings of a pedestrian crossings comprising several lighting devices sunk in asphalt each of them comprising a box being closed with a detachable lid having an external frame and being equipped with a window which is fixed by a protection frame, the window being made of tempered glass, the lid representing the transversal marking of the pedestrian crossing, the box comprising in the interior a LED lighting unit powdered by an electrical grid or a photovoltaic plant mounted on a supporting pole in the proximity of the pedestrian crossing, on the surface of the lid being poured bitumen subsequently painted with reflecting paint, so that the glass in the mounted state of the system, to be at the level of a roadway, on the supporting pole of the photovoltaic plant being installed a twilight sensor which will switch on some electric circuits of the LED lighting unit when reaching a certain minimum intensity of natural light.

2. The automatic lighting system of the transversal markings of the pedestrian crossings, according to claim 1, wherein at the longitudinal extremities of the pedestrian crossing made of the lighting devices sunk in asphalt, in the zone of the sidewalks, several laser sensors are provided having the role to trigger automatically the LED lighting unit the moment when a pedestrian enters the range of the mentioned sensors.

3. The automatic lighting system of the transversal markings of the pedestrian crossings, according to claim 1, wherein the longitudinal extremities of the pedestrian crossing made of lighting devices sunk in the asphalt, in the zone of the sidewalks, several pressure sensors are provided, which have the role to automatically trigger the LED lighting unit the moment when a pedestrian applied pressure on them.

4. The automatic lighting system of the transversal markings of the pedestrian crossings, according to claim 1, wherein on the supporting pole of the photovoltaic plant, an electric control panel of the LED lighting unit and of the cells of the photovoltaic plant is provided.

5. The automatic lighting system of the transversal markings of the pedestrian crossings according to claim 1, wherein the tempered glass is sandblasted in order to prevent the reflection of light during shiny days, and wherein between the protection frame and the piece of sandblasted tempered glass a belt of silicone putty is put to isolate the lighting device against water seepages.

6. The automatic lighting system of the transversal markings of the pedestrian crossings, according to claim 1, wherein the lid of the lighting device is provided with closing systems to allow the maintenance operations and to prevent unauthorized access inside the lighting device.

7. A process for obtaining the automatic lighting system of the transversal markings of the pedestrian crossings according to claim 1, comprising the following steps:

- stripping the asphalt out on all length and width of the old pedestrian crossing,
- fixing on the bottom of the formed hole a metallic net on which the boxes of the lighting devices of the automatic lighting system are welded,
- installing the LED lighting unit and coupling it to an electric control panel mounted on a pole near the pedestrian crossing,
- mounting, with the opportunity of detaching, the lid, of the LED lighting unit equipped with a central window made of tempered glass and fixed by a protection frame the lid representing the transversal marking of the pedestrian crossing,
- pouring bitumen on the surface of the lid of the LED lighting unit, between its exterior frame and the protection frame and subsequently painting with reflecting paint, so that the tempered glass in the mounted state of the system, to be at the level of the roadway,
- installing a twilight sensor which will switch on the electric circuits of the LED lighting unit when reaching a certain minimum intensity of the natural light.

8. The process according to claim 7, wherein the process supplementary comprises the step of mounting, at the longitudinal extremities of the pedestrian crossing made of lighting devices sunk in asphalt, in the area of the sidewalks, several laser sensors that have the role of triggering the LED lighting unit automatically when a pedestrian enters the range of action of the above mentioned sensors.

9. The process according to claim 7, wherein the process supplementary comprises the step of mounting, at the longitudinal extremities of the pedestrian crossing made of lighting devices sunk in asphalt, in the area of the sidewalks, several pressure sensors which have the role of triggering automatically the LED lighting unit when a pedestrian applies on them.

10. The automatic lighting system of the transversal markings of the pedestrian crossings, according to claim 3, wherein the longitudinal extremities of the pedestrian crossing made of lighting devices sunk in the asphalt, in the zone of the sidewalks, several pressure sensors are provided, which have the role to automatically trigger the LED lighting unit the moment when a pedestrian applied pressure on them.

11. The automatic lighting system of the transversal markings of the pedestrian crossings, according to claim 2, wherein on the supporting pole of the photovoltaic plant, an electric control panel of the LED lighting unit and of the cells of the photovoltaic plant is provided.

12. The automatic lighting system of the transversal markings of the pedestrian crossings, according to claim 3, wherein on the supporting pole of the photovoltaic plant, an electric control panel of the LED lighting unit and of the cells of the photovoltaic plant is provided.

13. The automatic lighting system of the transversal markings of the pedestrian crossings, according to claim 2, wherein the lid of the lighting device is provided with closing systems to allow the maintenance operations and to prevent unauthorized access inside the lighting device.

14. The automatic lighting system of the transversal markings of the pedestrian crossings, according to claim 3, wherein the lid of the lighting device is provided with closing systems to allow the maintenance operations and to prevent unauthorized access inside the lighting device.

15. The automatic lighting system of the transversal markings of the pedestrian crossings, according to claim 4, wherein the lid of the lighting device is provided with closing systems to allow the maintenance operations and to prevent unauthorized access inside the lighting device.

16. The automatic lighting system of the transversal markings of the pedestrian crossings, according to claim 5, wherein the lid of the lighting device is provided with closing systems to allow the maintenance operations and to prevent unauthorized access inside the lighting device.

* * * * *